United States Patent [19]

De Dianous

[11] Patent Number: 4,805,510

[45] Date of Patent: Feb. 21, 1989

[54] SYNTHESIZER-DRIVING PICKUP SYSTEM FOR BOWED STRING INSTRUMENT

[76] Inventor: Hervë De Dianous, Château des Meurs, Liniers (Vienne), France

[21] Appl. No.: 114,276

[22] Filed: Oct. 27, 1987

[51] Int. Cl.[4] ..... G10H 1/02; G10H 7/00

[52] U.S. Cl. ..... 84/1.16; 84/282

[58] Field of Search ..... 54/1.16, 1.14, 282, 54/DIG. 24, 1.15, 320, 325

[56] References Cited

U.S. PATENT DOCUMENTS

| | | | |
|---|---|---|---|
| 1,476,163 | 12/1923 | Matha | 84/282 |
| 2,933,967 | 4/1960 | Riscol | 84/1.16 |
| 3,003,382 | 10/1961 | Fender | 84/1.16 |
| 3,291,887 | 12/1966 | Carmen et al. | 84/1.16 |
| 4,147,084 | 4/1979 | Underwood | 84/1.16 |
| 4,171,659 | 10/1979 | Tumminaro | 84/1.16 |
| 4,468,999 | 9/1984 | Bonanno . | |
| 4,580,479 | 4/1986 | Bonanno . | |
| 4,630,520 | 12/1986 | Bonanno . | |

*Primary Examiner*—A. T. Grimley
*Assistant Examiner*—Matthew S. Smith
*Attorney, Agent, or Firm*—Browdy and Neimark

[57] ABSTRACT

A pickup assembly is used with a string instrument having a plurality of strings and an elongated fingerboard against which the strings can be stopped, a bow having a filament adapted to be drawn across the strings, and a frequency synthesizer. The assembly is composed of a pickup on the fingerboard for detecting which strings are stopped, where therealong, and for generating an output corresponding thereto, a pickup connected to the bow for detecting action thereof for generating an output corresponding thereto, and a pickup connected to the strings for detecting which string is being contacted by the bow and for generating an output corresponding thereof. These resultant, mainly analog signals are then fed to a processor that is connected to all of the pickup for receiving the outputs thereof, digitizing these outputs, and feeding the digitized outputs to the synthesizer.

9 Claims, 3 Drawing Sheets

17
60
59
58
57
56
55
54
53
48
45
47
52
51
50
49
44
43
42
41
46
40
38
39
36
37
35
34
33
32
31
30
IIIc
A
B
C
D
+
−

STRING DATA
63
75
76
77

ANALOG MULTIPLEXER
CLOCK
74
64
40
38
F
65
A/D CON-VERTER
66
73
72
67
68
71
PERIPHERAL INTERFACE ADAPTER
70
BOW DATA
78
79
80
69
A/D CONVERTER
E
84
83
61
62
PROCESSOR
ROM
85
ASYNCHRONOUS COMMUNICATION DEVICE
86
6
7
81
82
TO SYNTHESIZER

SYNTHESIZER-DRIVING PICKUP SYSTEM FOR BOWED STRING INSTRUMENT

FIELD OF THE INVENTION

The present invention relates to a pickup assembly for driving a frequency synthesizer from a string instrument. More particularly this invention concerns such a pickup assembly for a violin, viola, bass fiddle, or the like.

BACKGROUND OF THE INVENTION

A standard sound pickup for a violin or other bow-type string instrument typically is a simple microphone secured to the bridge of the instrument. The analog output of this microphone is filtered to isolate the fundamental and the resultant output is fed to a synthesizer which builds on it the desired sound.

Such an arrangement is simply adapted from other monophonic sources. It cannot capture the glissando effect and cannot reproduce the harmonics of a string instrument. In addition this system is useless in the scientific analysis of play as might for instance be used for instructional purposes.

OBJECTS OF THE INVENTION

It is therefore an object of the present invention to provide an improved pickup assembly for a bowed string instrument.

Another object is the provision of such a pickup assembly for a bowed string instrument which overcomes the above-given disadvantages, that is which can accurately keep track of all the elements of play so as to use them separately or together to drive a frequency synthesizer.

A further object is the provision of such a pickup assembly which can be used to analyze the elements of playing a bowed string instrument.

SUMMARY OF THE INVENTION

The pickup assembly of this invention is used with a string instrument having a plurality of strings and an elongated fingerboard against which the strings can be stopped, a bow having a filament adapted to be drawn across the strings, and a frequency synthesizer. The assembly comprises a pickup on the fingerboard for detecting which strings are stopped where therealong and for generating an output corresponding thereto, a pickup connected to the bow for detecting action thereof for generating an output corresponding thereto, and a pickup connected to the strings for detecting which string is being contacted by the bow and for generating an output corresponding thereof. These resultant, mainly analog signals are then fed to a processor that is connected to all of the pickup for receiving the outputs thereof, digitizing these outputs, and feeding the digitized outputs to the synthesizer.

In accordance with this invention the fingerboard pickup includes a transducer engageable by the strings as same are stopped and capable of generating the respective output indicating both the position along the fingerboard where a given string is stopped and also which string is being stopped. The bow pickup includes a pressure sensor on the stick of the bow capable of measuring tension therein and producing the output corresponding thereto. This bow pickup could also be, for instance, an accelerometer. The string pickup includes electrical connections to the strings and to the bow for generating the string output.

The fingerboard transducer is flat and glued to its upper surface so that it has no effect on play. In addition a connector is provided having a connector socket on the string instrument and a plug and wire engageable thereto connecting the pickup with the processor means. Furthermore according to this invention at least part of the processor is carried on the instrument. This processor part is mounted on the back side of the neck of the instrument.

The system of this invention therefore accurately determines which string or strings are being engaged by the bow, how hard the bow is engaging them, how fast the bow is moving, where on the bow the strings are being engaged, and which strings are stopped where on the fingerboard. Virtually every element that can effect sound output is individually monitored so that the subsequent massaging of this data by the synthesizer can be very complex.

From an instructional point of view the system of this invention can offer substantial assistance. First of all it is possible to use a smooth bow filament, replacing the normal rosined hair, producing little or no accurate sound, and to have the synthesizer make the notes for monitoring of play via headphones on the student and/or instructor. This makes it possible to practice a string instrument without disturbing others. In addition the digital data about play, for instance how fast the bow is moving as derived from its change in position with time, can be analyzed and compared to desired values, or to determine how to improve or cure a problem with play. Furthermore the system can be set to ignore modest imprecisions in fingering by always playing the exact right tone when the respective string is stopped slightly too short or too long so as to allow even a rank amateur to play with others or just gain confidence, or a readout could be given continuously showing how far off the player is from the actual perfect note of the given key or how much the bowing is varying with respect to the desired tempo, and so on.

DESCRIPTION OF THE DRAWING

The above and other objects, features, and advantages will become more apparent from the following, reference being made to the accompanying drawing in which.

SPECIFIC DESCRIPTION

Figure 1:
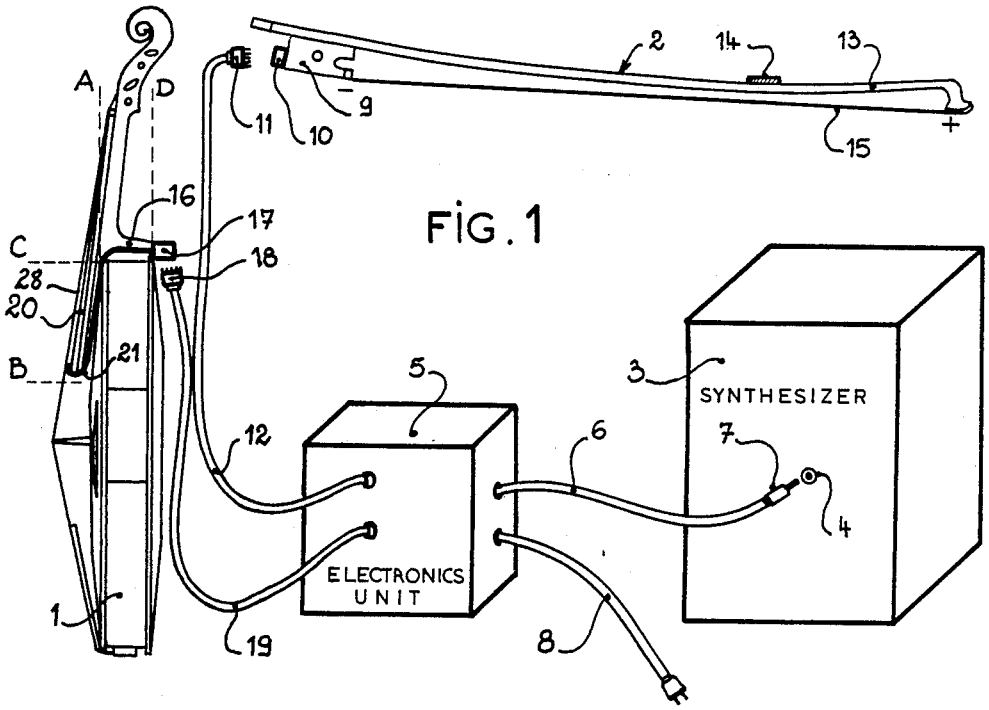
FIG. 1 is a mainly diagrammatic view of the system according to the present invention.

As seen in FIG. 1 a violin 1 that is normally played by means of a bow 2 is used to drive a standard frequency synthesizer 3 by its input 4. An electronics or processor unit 5 is connected by a cable 6 and MIDI jack 7 to the input 4, via a line cord 8 to the power source, and as will be described below to various pickups on the violin 1 and bow 2.

Figure 2:
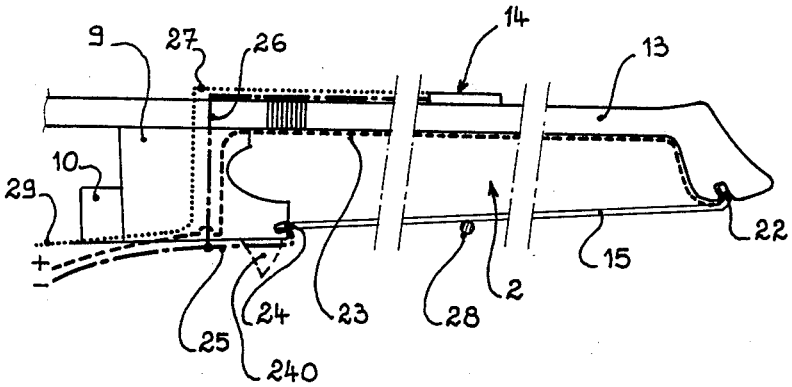
FIG. 2 is a large-scale and partly schematic view of the bow pickup according to this invention.

FIG. 2 shows how the bow 2 is provided at its handle or nut 9 with a multicontact socket 10 into which a plug 11 of a pickup cable 12 leads to the electronics unit 5. The bow 2 has, instead of the standard rosined hair, a filament 15 of high resistance. For example the filament 15 could be formed by 50 strands of silicon carbide of a resistance of 1000 ohm/cm. The outer end of this filament 15 is anchored at 22 on the tip of the bow 2 and the inner end at 24. The outer end is connected via a wire 23 and the inner end via a wire 25 to the connector 10 and thence to a 5-volt source within the unit 5. Presuming that one of the strings 28 is grounded the same as the inner filament end 24 and this string 28 engages the filament 15, it will act like the wiper of a potentiometer and pick up a voltage directly indicative of where along the filament 15 the string 28 touches. The higher the voltage, the closer to the outer end 22.

In addition the bow 2 has a stick 13 provided about one third of the way back from its outer end with a strain gauge 14 connected via one line 26 to the plus line 25 and via another line 27 to an output wire 29 connected via the wire 12 to the unit 2. The strain gauge 14 is of the standard type that changes resistance so that the voltage on the output line 29 will be directly proportional to how hard the bow 2 is being pressed against one or more strings 28. In addition a grounded element 240 can be provided at the nut 9 and can be used for pizzicato effects by directly grounding one of the strings 28.

Figures 3A, 3B, 3C:
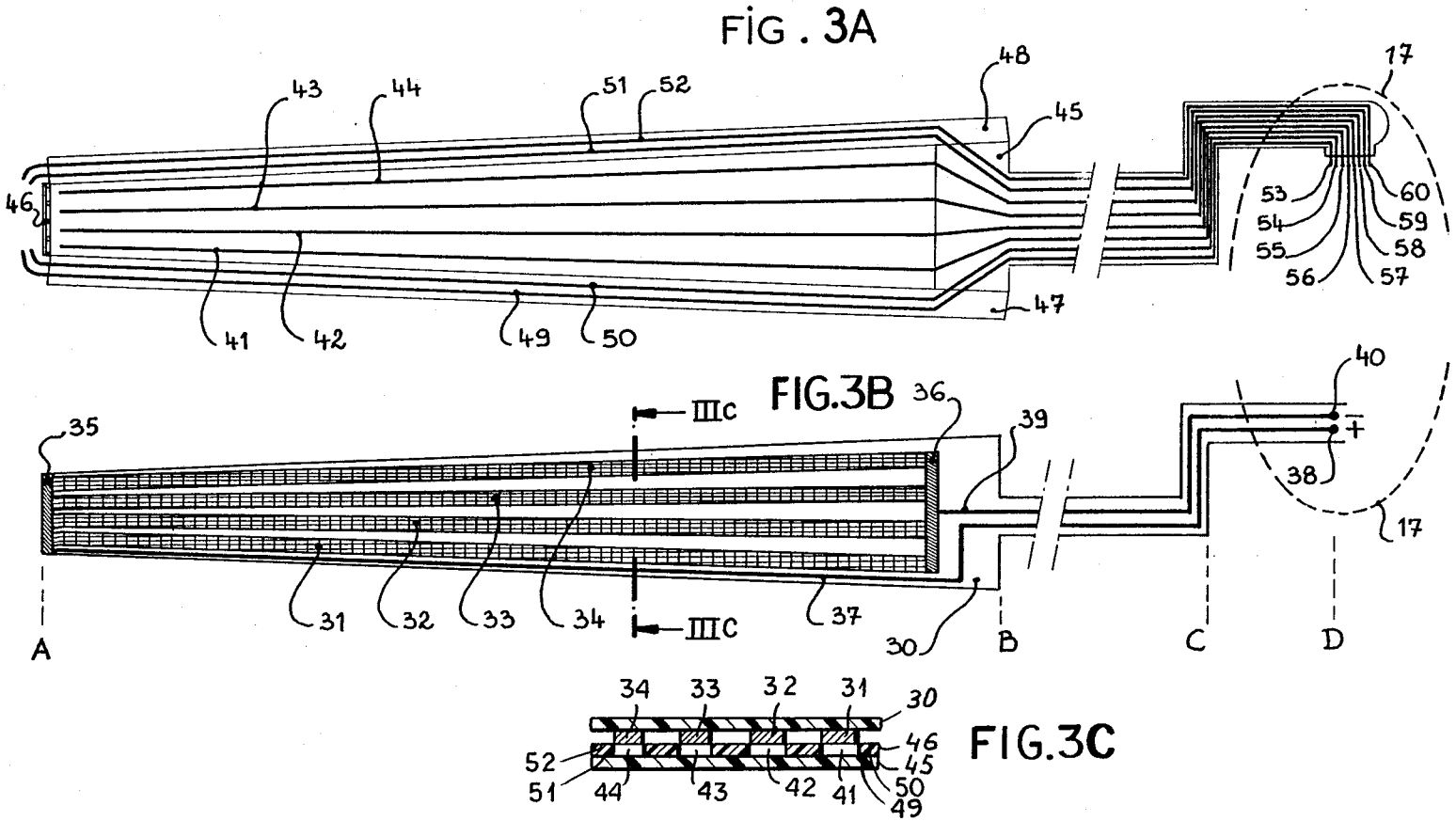
FIGS. 3A and 3B are top and back views of the fingerboard pickup of the invention.
FIG. 3C is a section taken along line IIIC—IIIC of FIG. 3B.

FIGS. 3A, 3B, and 3C show the pickup for the violin 1. It is comprised of a three-part laminate having upper and lower sheets 30 and 45 and an intermediate layer 46, all formed of a strong but flexible synthetic-resin sheet. The lower sheet 30 is laminated to the fingerboard 20 of the violin 1 and the upper sheet 45 is engageable by the strings 28 thereof. The end indicated at A is applied to the outer nut end of the fingerboard 20 and the other end is extended from B to C where it is applied underneath the fingerboard as indicated at 21 in FIG. 1 and then down the back 16 of the neck from C to D to a multicontact socket 17 matable with a plug 18 connected via a cable 19 to the unit 5. This pickup unit is therefore no hindrance to play or handling of the instrument 1.

The lower sheet 30 carries four contact strips 31, 32, 33, and 34 aligned with respective strings 28 of the violin 1. These strips 31 and 34 are formed as carbon bands of uniform resistance. The outer ends of the strips 31–34 are all connected to a conductive strip 35 connected via a positive line 37 to a terminal 38 in the socket 17 and the opposite ends are all connected at 36 to another line 39 connected to a negative terminal 40 of the socket 17.

The upper sheet 45 carries four wires 41, 42, 43, and 44 that are aligned above the respective strips 31 through 34. Side regions 47 and 48 of the upper sheet 45 are provided with conductors 49, 50, 51, and 52 that project from the outer end A where they are connected to the respective strings 28 of the violin 1, normally by small alligator clips. The wires 41–44 and 49–52 are connected at the socket 17 to respective terminals 53–60.

The intermediate layer 46 is only a few tenths of a millimeter thick and is formed between each wire 41 through 44 and the respective strip 31 through 34 with a window so that, when one of the wires 41–44 is pressed down, which happens when one of the strings 28 is stopped on the fingerboard, it engages the strip 34 underneath it. The voltage present at any location along any of the strips 31–34 is directly related to how far from the one or other end A or B contact is made. The closer to the outer end of the neck a given string 28 is stopped, the higher or more positive the voltage on the respective output line 41, 42, 43, or 44 will be and vice versa.

In addition the connections via the wires 49–52 to the strings 28 in conjunction with the use of a live filament 15 allow the unit 5 to determine not only which string or strings 28 are being engaged by the bow 2 at a given instant, but also where along the filament 15 they are being engaged, and for how long.

In summary, the pickup assembly of this invention is capable of directly determining the following information as the violin is being played:

1. Which string or strings 28 are being bowed.
2. Where the string or strings 28 are actually engaging the bow filament 15.
3. Where the string or strings 28 are being stopped against the fingerboard.
4. How much force the bow 2 is exerting on the string or strings 28.

From these various data outputs it is possible also to determine other factors. For instance the instantaneous rate of change of the location where the string or strings 28 engage the filament 15 gives bowing speed. The instantaneous rate of change of stop location can indicate a vibrato or other effect. Pizzicato is indicated when one of the strings 28 directly contacts the element 240.

Figure 4:
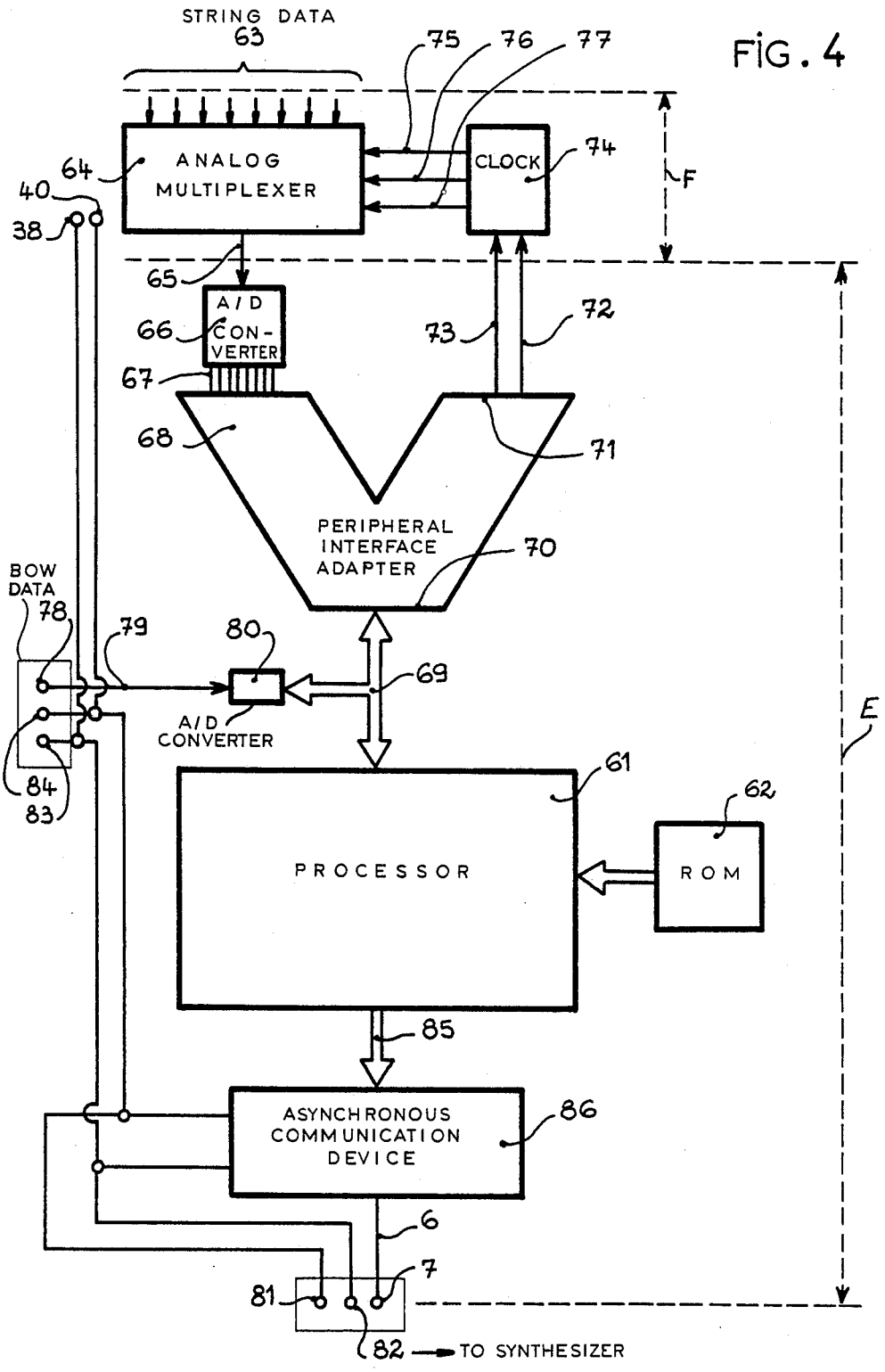
FIG. 4 is a schematic view of the processor of the system of this invention.

All this data is processed in a circuit shown in FIG. 4 and having an input part F that could be mounted right on the violin 1 upstream of the connector 17, and a main part E in the unit 5. This circuit is centered on a microprocessor 61 receiving its program set from a read-only memory 62. The eight-line input 63 from the cable 19 is received by an analog multiplexer 64 whose output 65 is fed to an analog-to-digital converter 66 whose eight-bit output 67 is fed to a peripheral interface adapter 68. A bus 69 feeds to an input 70 of this adapter 68 instructions from the processor 61 and an output 71 of the adapter 68 is connected by timer lines 72 and 73 to a clock circuit 74 whose three-bit output lines 75, 76 and 77 are connected to the multiplexer 64 to mark the incoming analog data with the time.

In addition data from the strain gauge 14 is fed to the input terminal 78 and fed via line 79 to another small analog-to-digital converter 80 whose output goes to the bus 69 and thence to the adapter 68 and processor 61. The system has input terminals 81 and 82 for receiving filtered direct-current voltage that is fed at 83 and 84 to the bow 2 and at 38 and 40 to the violin 1.

The output of the processor 61 is fed at 85 to an asynchronous communications device 86 having a serial output feeding the cable 6 and jack 7.

I claim:

1. In combination with:

a string instrument having a plurality of strings and an elongated fingerboard against which the strings can be stopped, a bow having a filament adapted to be drawn across the strings, and a frequency synthesizer, a pickup assembly comprising:

pickup means on the fingerboard for detecting which strings are stopped, where therealong and for, generating an output corresponding thereto;

pickup means connected to the bow for detecting action thereof for generating an output corresponding thereto; and pickup means connected to the strings for detecting which string is being contacted by the bow and for generating an output corresponding thereof.

2. The pickup assembly defined in claim 1, further comprising:

processor means connected to all of the pickup means for receiving the outputs thereof, digitizing these outputs, and feeding the digitized outputs to the synthesizer.

3. The pickup assembly defined in claim 2 wherein the fingerboard pickup means includes a transducer engageable by the strings as same are stopped and capable of generating the respective output indicating both the position along the fingerboard where a given string is stopped and also which string is being stopped, the bow pickup means includes a pressure sensor on the stick of the bow capable of measuring tension therein and producing the output corresponding thereto, and the string pickup means includes electrical connections to the strings and to the bow for generating the string output.

4. The pickup assembly defined in claim 3 wherein the transducer is flat and on the fingerboard.

5. The pickup assembly defined in claim 2, further comprising connector means including a connector socket on the string instrument and a plug and wire engageable thereto connecting the pickup means with the processor means.

6. The pickup assembly defined in claim 2 wherein at least part of the processor is carried on the instrument.

7. The pickup assembly defined in claim 6 wherein the processor part is mounted on the back side of the neck of the instrument.

8. In combination with:

a string instrument having a plurality of strings and an elongated fingerboard against which the strings can be stopped, a bow having a filament adapted to be drawn across the strings, and a frequency synthesizer, a pickup assembly comprising:

fingerboard pickup means including a flat touch pad engageable by the strings as same are stopped and capable of generating an respective output indicating both the position along the fingerboard where a given string is stopped and also which string is being stopped, bow pickup means including a pressure sensor on the stick of the bow capable of measuring tension therein and producing an output corresponding thereto, and pickup means connected to the strings and to the bow for detecting which string is being contacted by the bow and for generating an output corresponding thereof; and processor means connected to all of the pickup means for receiving the outputs thereof, digitizing these outputs, and feeding the digitized outputs to the synthesizer.

9. The pickup assembly defined in claim 8 wherein the filament of the bow is conductive but resistive and the strings of the violin are conductive.

* * * * *